US007375284B2

(12) United States Patent
Stutzman et al.

(10) Patent No.: US 7,375,284 B2
(45) Date of Patent: May 20, 2008

(54) MULTI-PAIR CABLE WITH VARYING LAY LENGTH

(75) Inventors: Spring Stutzman, Sidney, NE (US); Dave Wiekhorst, Potter, NE (US); Frederick W. Johnston, Dalton, NE (US); Scott Juengst, Sidney, NE (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/471,982

(22) Filed: Jun. 21, 2006

(65) Prior Publication Data

US 2007/0295526 A1 Dec. 27, 2007

(51) Int. Cl.
*H01B 7/00* (2006.01)

(52) U.S. Cl. ..... 174/110 R; 174/113 R; 174/113 C

(58) Field of Classification Search ..... 174/36, 174/110 R, 113 R, 113 A, 113 AS, 113 C, 174/116

See application file for complete search history.

(56) References Cited

U.S. PATENT DOCUMENTS

| | | | |
|---|---|---|---|
| 483,285 | A | 9/1892 | Guilleaume |
| 1,389,143 | A | 8/1921 | Kempton |
| 1,475,139 | A | 11/1923 | Pearson |
| 1,977,209 | A | 10/1934 | Sargent |
| 2,204,737 | A | 6/1940 | Swallow et al. |
| 2,556,244 | A | 6/1951 | Weston |
| 2,583,026 | A | 1/1952 | Swift |
| 2,804,494 | A | 8/1957 | Fenton |
| 2,959,102 | A | 11/1960 | Cook |
| 3,025,656 | A | 3/1962 | Cook |
| 3,052,079 | A | 9/1962 | Henning |
| 3,603,715 | A | 9/1971 | Ellhardt et al. |
| 3,621,118 | A | 11/1971 | Bunish et al. |
| 3,736,366 | A | 5/1973 | Wittenberg |
| 3,847,190 | A | 11/1974 | Forester |
| 3,921,381 | A | 11/1975 | Vogelsberg |
| 3,927,247 | A | 12/1975 | Timmons |
| 4,102,117 | A | 7/1978 | Dornberger |
| 4,211,462 | A | 7/1980 | Wolfthal |
| 4,263,471 | A | 4/1981 | Bauguion |
| 4,372,105 | A | 2/1983 | Ellis, Jr. |
| 4,408,443 | A | 10/1983 | Brown et al. |
| 4,413,469 | A | 11/1983 | Paquin |

(Continued)

FOREIGN PATENT DOCUMENTS

| | | |
|---|---|---|
| CA | 524452 | 5/1956 |

(Continued)

OTHER PUBLICATIONS

"Krone Product Data Sheet," 1 page (Jan. 16, 2001).

(Continued)

*Primary Examiner*—William H. Mayo, III
(74) *Attorney, Agent, or Firm*—Merchant & Gould P.C.

(57) ABSTRACT

A multi-pair cable having a plurality of twisted conductor pairs. The twisted conductor pairs each have an initial lay length that is different from that of the other twisted conductor pairs. The plurality of twisted conductor pairs defines a cable core. The core is twisted at a varying twist rate such that the cable core has a mean lay length of less than 2.5 inches.

30 Claims, 11 Drawing Sheets

U.S. PATENT DOCUMENTS 4,506,944 A 3/1985 Brennan et al.
4,654,476 A 3/1987 Barnicol-Ottler et al.
4,683,349 A 7/1987 Takebe
4,687,294 A 8/1987 Angeles
4,755,629 A 7/1988 Beggs et al.
4,807,962 A 2/1989 Arroyo et al.
4,889,503 A 12/1989 Philippson et al.
5,042,904 A 8/1991 Story et al.
5,059,140 A 10/1991 Philippson et al.
5,132,488 A 7/1992 Tessier et al.
5,177,809 A 1/1993 Zeidler
5,263,309 A 11/1993 Campbell et al.
5,286,923 A 2/1994 Prudhon et al.
5,289,556 A 2/1994 Rawlyk et al.
5,298,680 A 3/1994 Kenny
5,399,813 A 3/1995 McNeill et al.
5,424,491 A 6/1995 Walling et al.
5,493,071 A 2/1996 Newmoyer
5,514,837 A 5/1996 Kenny et al.
5,525,757 A 6/1996 O'Brien
5,535,579 A 7/1996 Berry, III et al.
5,544,270 A 8/1996 Clark et al.
5,564,268 A 10/1996 Thompson
5,565,653 A 10/1996 Rofidal et al.
5,574,250 A 11/1996 Hardie et al.
5,597,981 A 1/1997 Hinoshita et al.
5,606,151 A 2/1997 Siekierka et al.
5,614,319 A 3/1997 Wessels et al.
5,659,152 A 8/1997 Horie et al.
5,706,642 A 1/1998 Haselwander
5,734,126 A 3/1998 Siekierka et al.
5,739,473 A 4/1998 Zerbs
5,742,002 A 4/1998 Arredondo et al.
5,744,757 A 4/1998 Kenny et al.
5,763,823 A 6/1998 Siekierka et al.
5,767,441 A 6/1998 Brorein et al.
5,770,820 A * 6/1998 Nelson et al. ..... 174/113 R
5,789,711 A 8/1998 Gaeris et al.
5,814,768 A 9/1998 Wessels et al.
5,821,466 A * 10/1998 Clark et al. ..... 174/113 R
5,902,962 A 5/1999 Gazdzinski
5,922,155 A 7/1999 Clouet et al.
5,952,607 A 9/1999 Friesen et al.
5,952,615 A 9/1999 Prudhon
5,966,917 A 10/1999 Thompson
5,969,295 A 10/1999 Boucino et al.
5,990,419 A 11/1999 Bogese, II
6,074,503 A 6/2000 Clark et al.
6,091,025 A 7/2000 Cotter et al.
6,096,977 A 8/2000 Beggs et al.
6,139,957 A 10/2000 Craton
6,150,612 A 11/2000 Grandy et al.
6,153,826 A 11/2000 Kenny et al.
6,194,663 B1 2/2001 Friesen et al.
6,211,467 B1 4/2001 Berelsman et al.
6,222,129 B1 4/2001 Siekierka et al.
6,222,130 B1 4/2001 Gareis et al.
6,248,954 B1 6/2001 Clark et al.
6,254,924 B1 7/2001 Brorein et al.
6,259,031 B1 7/2001 Totland et al.
6,267,628 B1 7/2001 Meckley et al.
6,297,454 B1 10/2001 Gareis
6,300,573 B1 10/2001 Horie et al.
6,318,062 B1 11/2001 Doherty
6,323,427 B1 11/2001 Rutledge
6,342,678 B1 1/2002 Knop et al.
6,348,651 B1 2/2002 Chou et al.
6,355,876 B1 3/2002 Morimoto
6,378,283 B1 4/2002 Barton
6,392,152 B1 5/2002 Mottine, Jr. et al.
6,402,559 B1 6/2002 Marowsky et al.
6,433,272 B1 8/2002 Buhler et al.
6,452,094 B2 9/2002 Donner et al.
6,476,323 B2 11/2002 Beebe et al.
6,495,762 B2 12/2002 Arzate et al.
6,506,976 B1 1/2003 Neveux, Jr.
6,566,607 B1 5/2003 Walling
6,624,359 B2 9/2003 Bahlmann et al.
6,639,152 B2 10/2003 Glew et al.
6,684,030 B1 1/2004 Taylor et al.
6,770,819 B2 8/2004 Patel
6,787,697 B2 9/2004 Stipes et al.
6,800,811 B1 10/2004 Boucino
6,812,408 B2 11/2004 Clark et al.
6,818,832 B2 11/2004 Hopkinson et al.
6,855,889 B2 2/2005 Gareis
6,875,928 B1 4/2005 Hayes et al.
6,959,533 B2 11/2005 Noel et al.
7,115,815 B2 10/2006 Kenny et al.
2004/0112628 A1* 6/2004 Brandi et al. ..... 174/113 R
2004/0149483 A1 8/2004 Glew
2004/0149484 A1 8/2004 Clark
2005/0006132 A1 1/2005 Clark
2005/0045367 A1 3/2005 Somers et al.
2005/0087361 A1 4/2005 Hayes et al.
2005/0092515 A1 5/2005 Kenny et al.
2005/0103518 A1 5/2005 Glew
2005/0269125 A1 12/2005 Clark
2006/0162949 A1* 7/2006 Bolouri-Saransar et al. ..... 174/113 R
2007/0144762 A1 6/2007 Stutzman et al.

FOREIGN PATENT DOCUMENTS

DE 68264 4/1893
DE 24 59 844 7/1976
EP 0 367 473 A1 5/1990
EP 1 215 688 A1 6/2002
JP 5-101711 4/1993
JP 6-349344 12/1994
US 1 162 632 A2 * 5/2001
WO WO 01/41158 A1 6/2001

OTHER PUBLICATIONS

NORDX/CDT Paid Advertisement; 3 pages (Dec. 14, 2000).
U.S. Appl. No. 11/402,250; *Telecommunications Jack with Crosstalk Compensation Provided on a Multi-Layer Circuit Board*; 36 pages (filed Apr. 11, 2006).

* cited by examiner

| Pair 12 | | Pair 36 | | Pair 45 | | Pair 78 | |
|---|---|---|---|---|---|---|---|
| Freq (MHz) | Margin (dB) | Freq (MHz) | Margin (dB) | Freq (MHz) | Margin (dB) | Freq (MHz) | Margin (dB) |
| 497.51 | 1.36 | 486.90 | -2.96 | 483.16 | 2.84 | 483.16 | 1.85 |

| Pair 12 | | Pair 36 | | Pair 45 | | Pair 78 | |
|---|---|---|---|---|---|---|---|
| Freq (MHz) | Margin (dB) | Freq (MHz) | Margin (dB) | Freq (MHz) | Margin (dB) | Freq (MHz) | Margin (dB) |
| 493.14 | 3.57 | 447.61 | 4.38 | 86.45 | 4.06 | 400.20 | 3.47 |

| Forward | | Reverse | |
|---|---|---|---|
| Freq (MHz) | Margin (dB) | Freq (MHz) | Margin (dB) |
| 484.81 | -0.57 | 489.40 | 0.42 |

| Forward | | Reverse | |
|---|---|---|---|
| Freq (MHz) | Margin (dB) | Freq (MHz) | Margin (dB) |
| 446.98 | 3.09 | | |

MULTI-PAIR CABLE WITH VARYING LAY LENGTH

TECHNICAL FIELD

The present disclosure relates generally to cables for use in the telecommunications industry, and various methods associated with such cables. More particularly, this disclosure relates to telecommunication cabling having twisted conductor pairs.

BACKGROUND

The telecommunications industry utilizes cabling in a wide range of applications. Some cabling arrangements include twisted pairs of insulated conductors, the pairs being twisted about each other to define a twisted pair core. An insulating jacket is typically extruded over the twisted pair core to maintain the configuration of the core, and to function as a protective layer. Such cabling is commonly referred to as a multi-pair cable.

The telecommunications industry is continuously striving to increase the speed and/or volume of signal transmissions through such multi-pair cables. One problem that concerns the telecommunications industry is the increased occurrence of crosstalk associated with high-speed signal transmissions.

In general, improvement has been sought with respect to multi-pair cable arrangements, generally to improve transmission performance by reducing the occurrence of crosstalk.

SUMMARY

One aspect of the present disclosure relates to a multi-pair cable having a plurality of twisted pairs that define a cable core. The cable core is twisted at a varying twist rate such the mean core lay length of the cable core is less than about 2.5 inches. Another aspect of the present disclosure relates to a method of making a cable having a varying twist rate with a mean core lay length of less than about 2.5 inches. Still another aspect of the present disclosure relates to the use of a multi-pair cable in a patch cord, the cable being constructed to reduce crosstalk at a connector assembly of the patch cord.

A variety of examples of desirable product features or methods are set forth in part in the description that follows, and in part will be apparent from the description, or may be learned by practicing various aspects of the disclosure. The aspects of the disclosure may relate to individual features as well as combinations of features. It is to be understood that both the foregoing general description and the following detailed description are explanatory only, and are not restrictive of the claimed invention.

DETAILED DESCRIPTION

Reference will now be made in detail to various features of the present disclosure that are illustrated in the accompanying drawings. Wherever possible, the same reference numbers will be used throughout the drawings to refer to the same or like parts.

Figure 1:
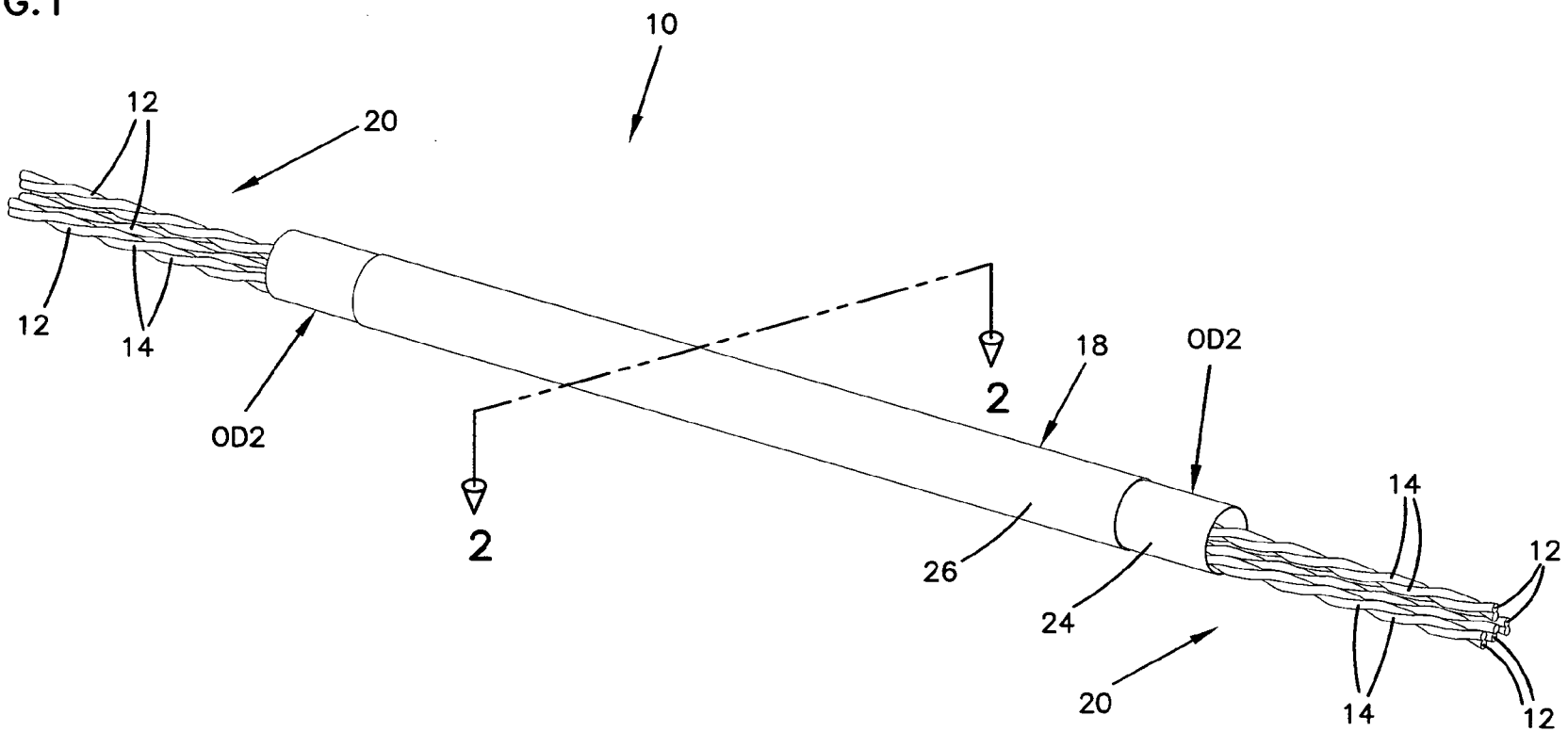
FIG. 1 is a perspective view of one embodiment of a cable in accordance with the principles of the present disclosure.

FIG. 1 illustrates one embodiment of a cable 10 having features that are examples of how inventive aspects in accordance with the principles of the present disclosure may be practiced. Preferred features are adapted for reducing crosstalk between twisted pairs of the cable, and for reducing crosstalk between adjacent cables.

Referring to FIG. 1, the cable 10 of the present disclosure includes a plurality of twisted pairs 12. In the illustrated embodiment, the cable 10 includes four twisted pairs 12. Each of the four twisted pairs includes first and second insulated conductors 14 twisted about one another along a longitudinal pair axis (see FIG. 3).

The conductors of the insulated conductors 14 may be made of copper, aluminum, copper-clad steel and plated copper, for example. It has been found that copper is an optimal conductor material. In one embodiment, the conductors are made of braided copper. One example of a braided copper conductor construction that can be used is described in greater detail in U.S. Pat. No. 6,323,427, which is incorporated herein by reference. In addition, the conductors may be made of glass or plastic fiber such that a fiber optic cable is produced in accordance with the principles disclosed. The insulating layer of the insulated conductors 14 can be made of known materials, such as fluoropolymers or other electrical insulating materials, for example.

Figure 2:
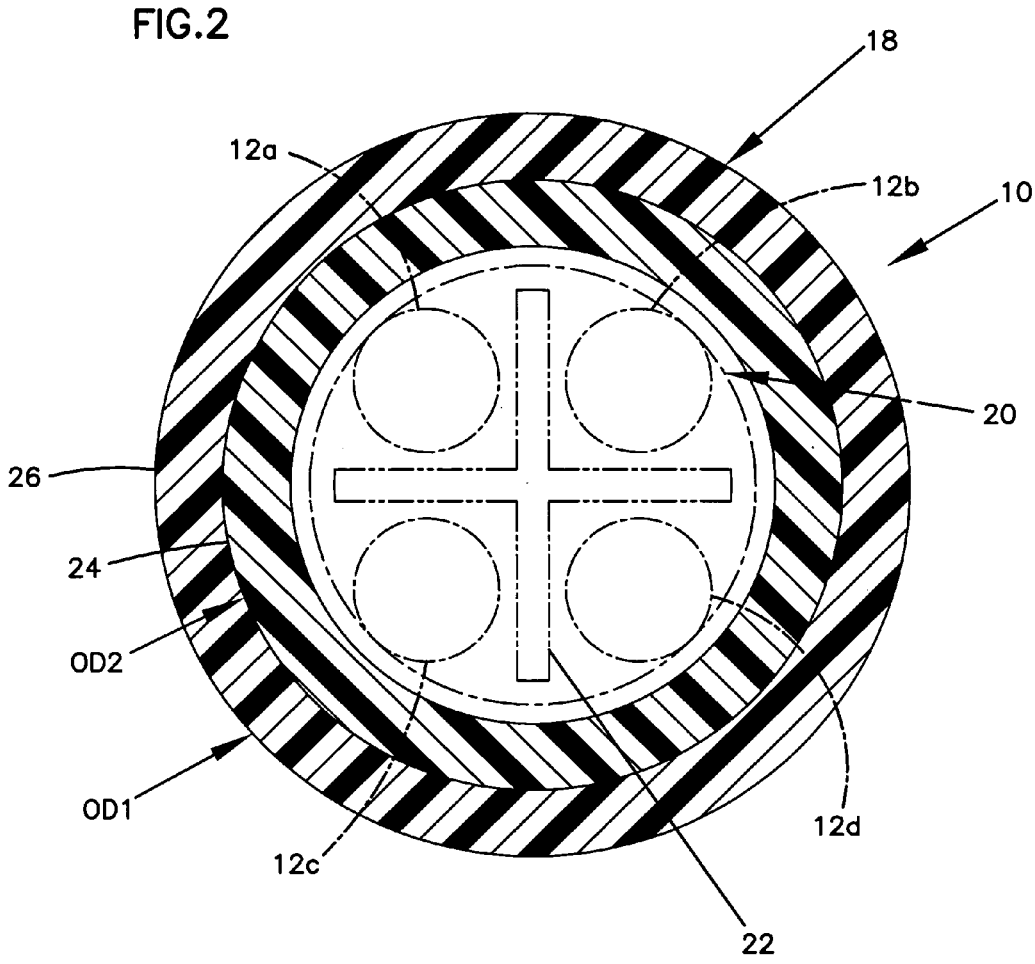
FIG. 2 is a cross-sectional view of the cable of FIG. 1, taken along line 2-2.

The plurality of twisted pairs 12 of the cable 10 defines a cable core 20. In the illustrated embodiment of FIG. 1, the core 20 includes only the plurality of twisted pairs 12. In alternative embodiments, the core may also include a spacer that separates or divides the twisted pairs 12. FIG. 2 illustrates one example of a star-type spacer 22 (represented in dashed lines) that can be used to divide the four twisted pairs 12*a*-12*d*. Other spacers, such as flexible tape strips or fillers defining pockets and having retaining elements that retain each of the twisted pairs within the pockets, can also be used. Additional spacer examples that can be used are described in U.S. patent application Ser. Nos. 10/746,800, 10/746,757, and 11/318,350; which applications are incorporated herein by reference.

Referring now to FIGS. 1 and 2, in one embodiment, the cable 10 includes a double jacket 18 that surrounds the core 20 of twisted pairs 12. The double jacket 18 includes both a first inner jacket 24 and a second outer jacket 26. The inner jacket 24 surrounds the core 20 of twisted pairs 12. The outer jacket 26 surrounds the inner jacket 24. The inner and outer jackets 24, 26 function not only to maintain the relative positioning of the twisted pairs 12, but also to lessen the occurrence of alien crosstalk without utilizing added shielding.

In particular, the addition of the outer jacket 26 to the cable 10 reduces the capacitance of the cable 10 by increasing the center-to-center distance between the cable 10 and an adjacent cable. Reducing the capacitance by increasing the center-to-center distance between two adjacent cables reduces the occurrence of alien crosstalk between the cables. Accordingly, the outer jacket 26 has an outer diameter OD1 (FIG. 2) that distances the core 20 of twisted pairs 12 from adjacent cables. Ideally, the cores 20 of twisted pairs 12 of adjacent cables are as far apart as possible to minimize the capacitance between adjacent cables.

There are, however, limits to how far apart the double jacket 18 can place one cable from an adjacent cable. Practical, as well as economical constraints are imposed on the size of the resulting double jacket cable. A cable cannot be so large that it is impractical to use in an intended environment, and cannot be so large as to preclude use with existing standard connectors. In the illustrated embodiment, the outer diameter OD1 (FIG. 2) of the outer jacket 26 is between about 0.295 inches and 0.310 inches.

The disclosed double jacket is provided as two separate inner and outer jackets 24, 26, as opposed to a single, extra thick jacket layer. This double jacket feature reduces alien crosstalk by distancing the cores of adjacent cables, while at the same time, accommodating existing design limitations of cable connectors. For example, the double jacket 18 of the present cable 10 accommodates cable connectors that attach to a cable jacket having a specific outer diameter. In particular, the present cable 10 permits a user to strip away a portion of the outer jacket 26 (see FIG. 1) so that a cable connector can be attached to the outer diameter OD2 of the inner jacket 24. In the illustrated embodiment, the inner jacket 24 has an outer diameter OD2 of between about 0.236 and 0.250 inches.

The inner jacket 24 and the outer jacket 26 of the present cable 10 can be made from similar materials, or can be made of materials different from one another. Common materials that can be used to manufacture the inner and outer jackets include plastic materials, such as fluoropolymers (e.g. ethylenechlorotrifluorothylene (ECTF) and Flurothylenepropylene (FEP)), polyvinyl chloride (PVC), polyethelene, or other electrically insulating materials, for example. In addition, a low-smoke zero-halogen material, such as polyolefin, can also be used. While these materials are used because of their cost effectiveness and/or flame and smoke retardancy, other material may be used in accordance with the principles disclosed.

In the manufacture of the present cable 10, two insulated conductors 14 are fed into a pair twisting machine, commonly referred to as a twinner. The twinner twists the two insulated conductors 14 about the longitudinal pair axis at a predetermined twist rate to produce the single twisted pair 12. The twisted pair 12 can be twisted in a right-handed twist direction or a left-handed twist direction.

Figure 3:
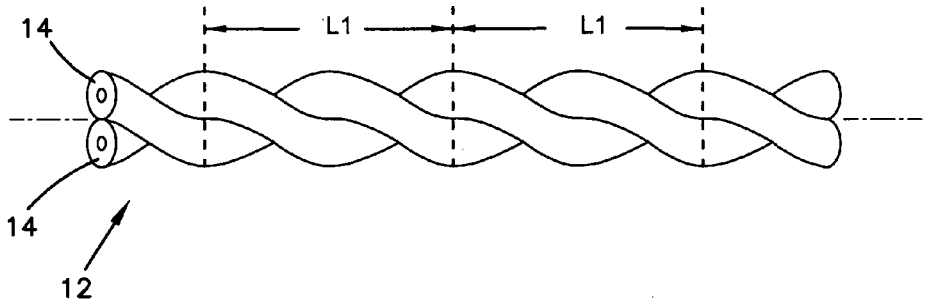
FIG. 3 is a schematic representation of a twisted pair of the cable of FIG. 1.

Referring now to FIG. 3, each of the twisted pairs 12 of the cable 10 is twisted about its longitudinal pair axis at a particular twist rate (only one representative twisted pair shown). The twist rate is the number of twists completed in one unit of length of the twisted pair. The twist rate defines a lay length L1 of the twisted pair. The lay length L1 is the distance in length of one complete twist cycle. For example, a twisted pair having a twist rate of 0.250 twists per inch has a lay length of 4.0 inches (i.e., the two conductors complete one full twist, peak-to-peak, along a length of 4.0 inches of the twisted pair).

In the illustrated embodiment, each of the twisted pairs 12*a*-12*d* of the cable 10 has a lay length L1 or twist rate different from that of the other twisted pairs. This aids in reducing crosstalk between the pairs of the cable core 20. In the illustrated embodiment, the lay length L1 of each of the twisted pairs 12*a*-12*d* is generally constant, with the exception of variations due to manufacturing tolerances. In alternative embodiments, the lay length may be purposely varied along the length of the twisted pair.

Each of the twisted pairs 12*a*-12*d* of the present cable 10 is twisted in the same direction (i.e., all in the right-hand direction or all in the left-hand direction). In addition, the individual lay length of each of the twisted pairs 12*a*-12*d* is generally between about 0.300 and 0.500 inches. In one embodiment, each of the twisted pairs 12*a*-12*d* is manufactured with a different lay length, twisted in the same direction, as shown in Table A below.

TABLE A

| Twisted Pair | Twist Rate (twists per inches) | Lay Length L1 (inches) |
|---|---|---|
| 12a | 3.03 to 2.86 | .330 to .350 |
| 12b | 2.56 to 2.44 | .390 to .410 |
| 12c | 2.82 to 2.67 | .355 to .375 |
| 12d | 2.41 to 2.30 | .415 to .435 |

In the illustrated embodiment, the first twisted pair 12*a* (FIG. 2) has a lay length of about 0.339 inches; the second twisted pair 12*b* has a lay length of about 0.400 inches; the third twisted pair 12*c* has a lay length of about 0.365 inches; and the fourth twisted pair 12*d* has a lay length of about 0.425 inches. As will be described in greater detail hereinafter, each of the lay lengths L1 of the twisted pairs described above are initial lay lengths.

The cable core 20 of the cable 10 is made by twisting together the plurality of twisted pairs 12*a*-12*d* at a cable twist rate. The machine producing the twisted cable core 20 is commonly referred to as a cabler. Similar to the twisted pairs, the cable twist rate of the cable core 20 is the number of twists completed in one unit of length of the cable or cable core. The cable twist rate defines a core or cable lay length of the cable 10. The cable lay length is the distance in length of one complete twist cycle.

In manufacturing the present cable 10, the cabler twists the cable core 20 about a central core axis in the same direction as the direction in which the twisted pairs 12*a*-12*d* are twisted. Twisting the cable core 20 in the same direction as the direction in which the twisted pairs 12*a*-12*d* are twisted causes the twist rate of the twisted pairs 12*a*-12*d* to increase or tighten as the cabler twists the pairs about the central core axis. Accordingly, twisting the cable core 20 in the same direction as the direction in which the twisted pairs are twisted causes the lay lengths of the twisted pairs to decrease or shorten.

In the illustrated embodiment, the cable 10 is manufactured such that the cable lay length varies between about 1.5 inches and about 2.5 inches. The varying cable lay length of the cable core 20 can vary either incrementally or continuously. In one embodiment, the cable lay length varies randomly along the length of the cable 10. The randomly varying cable lay length is produced by an algorithm program of the cabler machine.

Because the cable lay length of the cable 10 is varied, the once generally constant lay lengths of the twisted pairs 12*a*-12*b* are now also varied; that is, the initial lay lengths of the twisted pairs 12 now take on the varying characteristics of the cable core 20. In the illustrated embodiment, with the cable core 20 and each of the twisted pairs 12*a*-12*d* twisted in the same direction at the cable lay length of between 1.5 and 2.5 inches, the now varying lay lengths of each of the twisted pairs fall between the values shown in columns 3 and 4 of Table B below.

TABLE B

| Twisted Pair | Initial Lay Length prior to Core Twist (inches) | Approx. Lay Length w/Cable Lay Length of 1.5 (inches) | Approx. Lay Length w/Cable Lay Length of 2.5 (inches) | Resulting Mean Lay Length after Core Twist (inches) |
|---|---|---|---|---|
| 12a | .339 | .2765 | .2985 | .288 |
| 12b | .400 | .3158 | .3448 | .330 |
| 12c | .365 | .2936 | .3185 | .306 |
| 12d | .425 | .3312 | .3632 | .347 |

As previously described, the cable lay length of the cable core 20 varies between about 1.5 and about 2.5 inches. The mean or average cable lay length is therefore less than about 2.5 inches. In the illustrated embodiment, the mean cable lay length is about 2.0 inches.

Referring to Table B above, the first twisted pair 12*a* of the cable 10 has a lay length of about 0.2765 inches at a point along the cable where the point specific lay length of the core is 1.5 inches. The first twisted pair 12*a* has a lay length of about 0.2985 inches at a point along the cable where the point specific lay length of the core is 2.5 inches. Because the lay length of the cable core 20 is varied between 1.5 and 2.5 inches along the length of the cable 10, the first twisted pair 12*a* accordingly has a lay length that varies between about 0.2765 and 0.2985 inches. The mean lay length of the first twisted pair 12*a* resulting from the twisting of the cable core 20 is 0.288 inches. Each of the other twisted pairs 12*b*-12*d* similarly has a mean lay length resulting from the twisting of the cable core 20. The resulting mean lay length of each of the twisted pairs 12*a*-12*d* is shown in column 5 of Table B. It is to be understood that the mean lay lengths are approximate mean or average lay length values, and that such mean lay lengths may differ slightly from the values shown due to manufacturing tolerances.

Twisted pairs having similar lay lengths (i.e., parallel twisted pairs) are more susceptible to crosstalk than are non-parallel twisted pairs. The increased susceptibility to crosstalk exists because interference fields produced by a first twisted pair are oriented in directions that readily influence other twisted pairs that are parallel to the first twisted pair. Intra-cable crosstalk is reduced by varying the lay lengths of the individual twisted pairs over their lengths and thereby providing non-parallel twisted pairs.

The presently described method of providing individual twisted pairs with the particular disclosed varying lay lengths produces advantageous results with respect to reducing crosstalk and improving cable performance. In one application, the features of the present cable 10 can be used to provide an improved patch cord.

Figure 4:
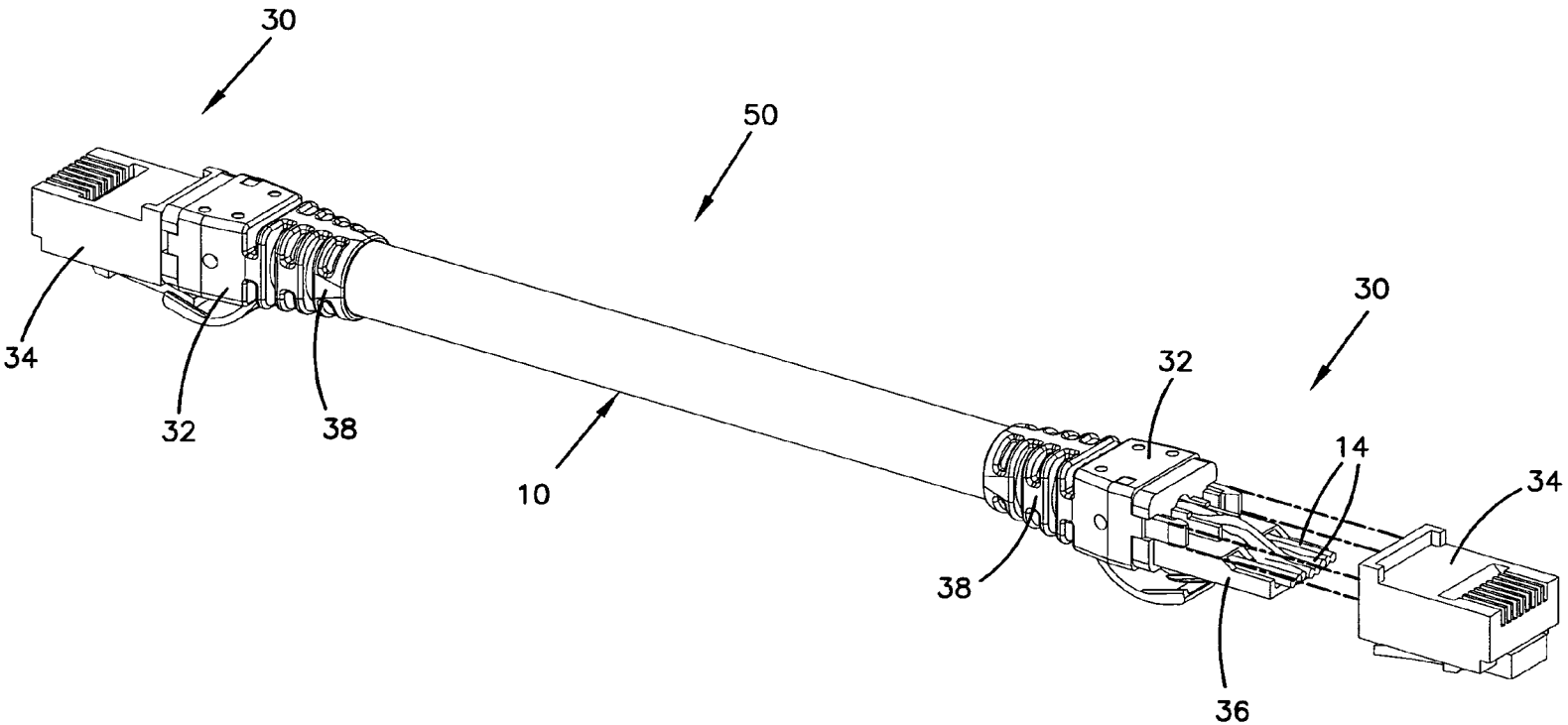
FIG. 4 is a perspective view of one embodiment of a patch cord utilizing the cable of FIG. 1 in accordance with the principles of the present disclosure.

Referring now to FIG. 4, one embodiment of a patch cord 50 manufactured in accordance with the principles disclosed is illustrated. The patch cord 50 includes the cable 10 previously described. Connector assemblies or jacks 30 are attached at each end of the cable 10. In the illustrated embodiment, each of the jacks 30 includes a connector housing 32, a plug housing 34, and a channeled insert 36. Each of the connector housing 32, the plug housing 34, and the channeled insert 36 includes structure that provides a snap-fit connection between one another. Other types of jacks can be used in accordance with the principles disclosed. One other type of jack that can be used is described in U.S. patent application Ser. No. 11/402,250; which application is incorporated herein by reference.

Figure 5:
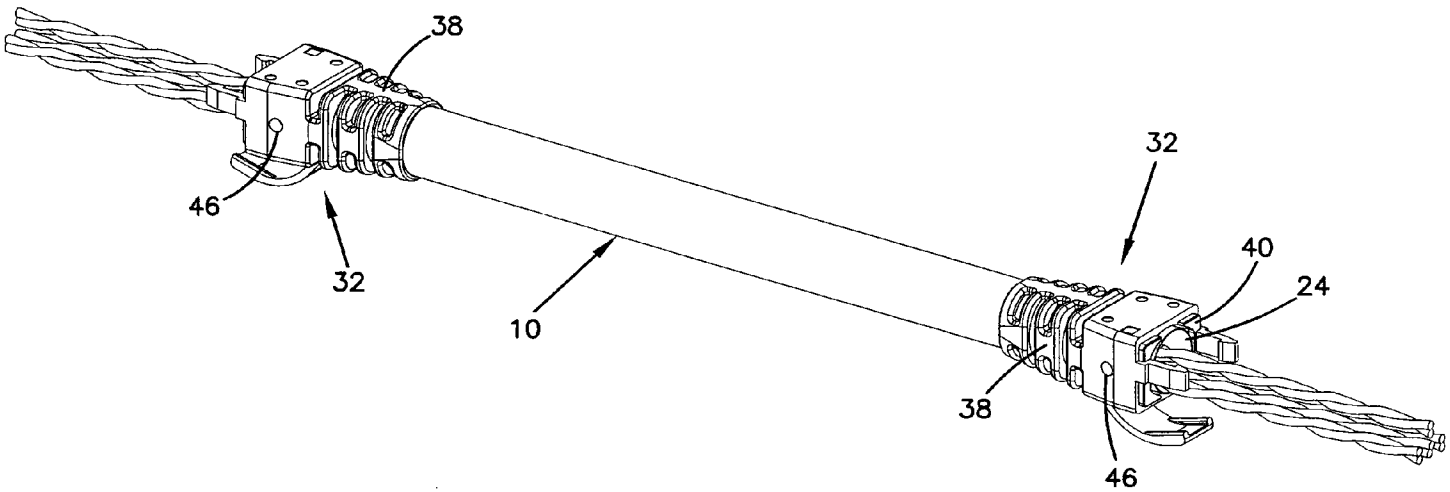
FIG. 5 is a perspective view of the patch cord of FIG. 4, shown with only a portion of a connector assembly.
Figure 7:
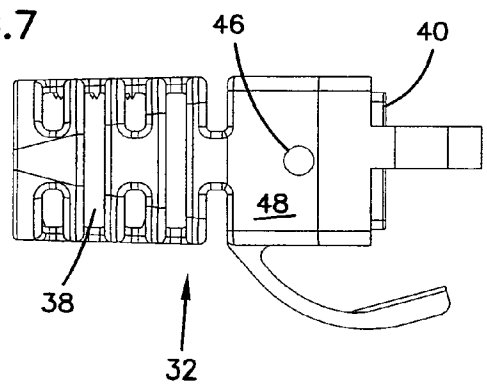
FIG. 7 is a side elevation view of the connector housing of FIG. 6.
Figure 6:
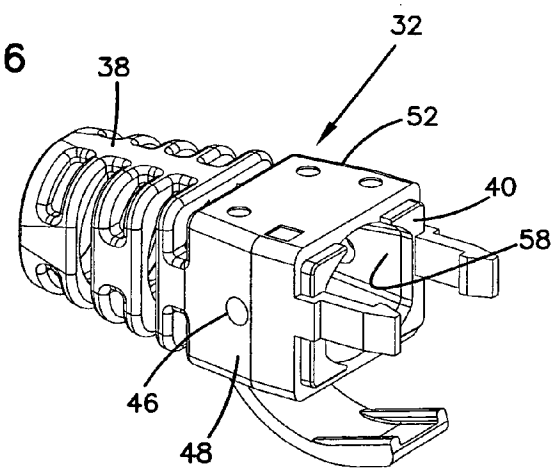
FIG. 6 is a perspective view of a connector housing of the connector assembly portion shown in FIG. 5.

Referring now to FIGS. 5-7, the connector housing 32 of the disclosed jack 30 has a strain relief boot 38 sized to fit around the outer diameter OD2 of the inner jacket 24 (FIG. 1). During assembly, the connector housing 32 is positioned such that the end of the inner jacket 24 is flush with a surface 40 (FIGS. 5 and 6) of the connector housing 32. Referring to FIG. 1, the outer jacket 26 is stripped away from the inner jacket 24 a distance to accommodate the length of the strain relief boot 38 and permit the flush positioning of the inner jacket 24 relative to the connector housing 32. The plurality of twisted pairs 12 extends through the connector housing 32 (FIG. 5) when the connector housing 32 is placed on the end of the cable 10.

When the connector housing 32 is in place, as shown in FIG. 5, the channeled insert 36 (FIG. 8) is snap fit to the connector housing 32. The connector housing 32 has a somewhat loose fit about the outer diameter OD2 of the inner jacket 24. Snap-fitting the channeled insert 36 to the connector housing 32 secures the connection of the jack 30 (i.e., of the channeled insert 36 and the connected connector housing 32) to the cable 10. In particular, referring to FIGS. 8-10, the channeled insert 36 includes a number of flexible prongs 56. The connector housing 32 includes a ramped interior surface 58 (FIG. 6). When the prongs 56 of the channeled insert 36 are inserted within the connector housing 32, the ramped interior surface 58 of the connector housing 32 contacts and radially biases the prongs 56 inward. This causes the prongs 56 to clamp around the outer diameter OD2 of the inner jacket 24, and thereby secure the jack 30 to the end of the cable 10.

Figure 8:
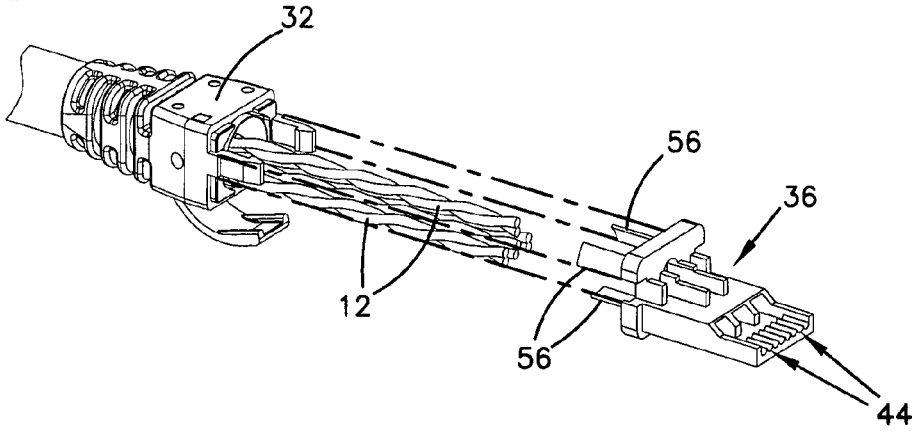
FIG. 8 is a partial perspective view of the patch cord of FIG. 5, shown with a channeled insert of the connector assembly.
Figure 9:
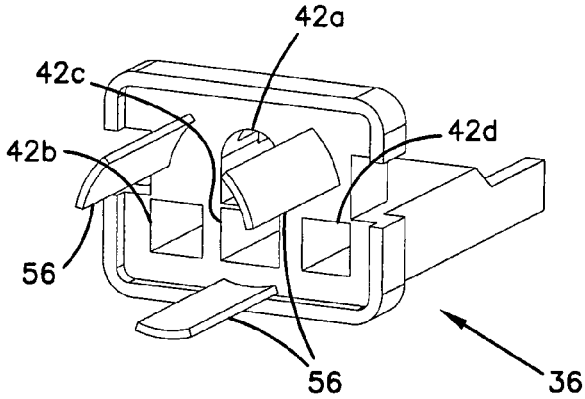
FIG. 9 is a perspective view of the channeled insert of FIG. 8.
Figure 10:
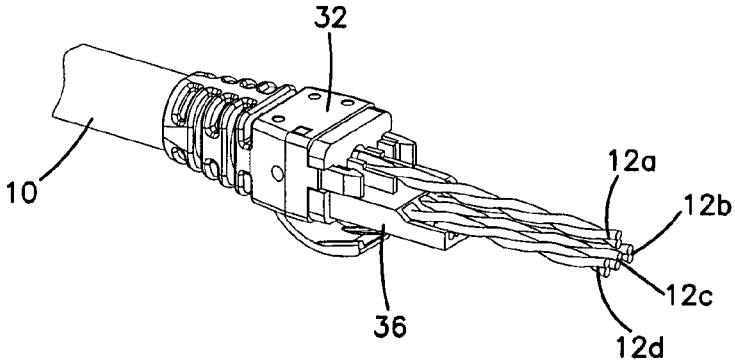
FIG. 10 is a partial perspective view of the patch cord of FIG. 8, shown with the channeled insert connected to the connector housing.

Referring to FIGS. 8 and 9, the channeled insert 36 further defines four pair-receiving apertures 42*a*-42*d* (FIG. 9) and eight channels 44 (FIG. 8). Each of the pair-receiving apertures 42*a*-42*d* receives one of the twisted pairs 12. Each of the channels 44 receives one of the insulated conductors 14 of the twisted pairs 12. The apertures 42*a*-42*d* of the channeled insert 36 separate and position each of the twisted pairs 12 for placement within the channels 44, as shown in FIG. 11.

Figure 11:
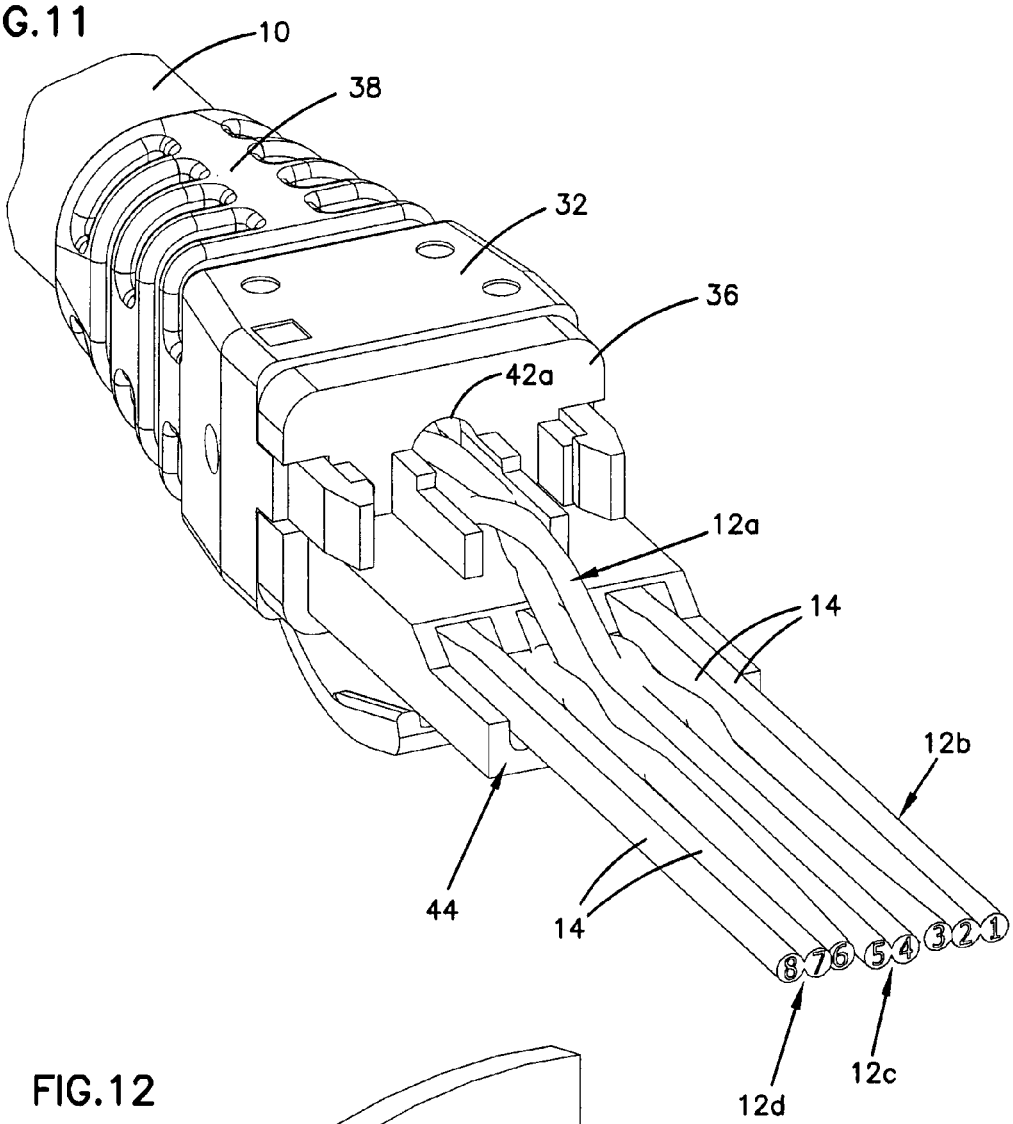
FIG. 11 is a partial perspective view of the patch cord of FIG. 10, shown with insulated conductors of twisted pairs positioned within channels of the channeled insert.
Figure 12:
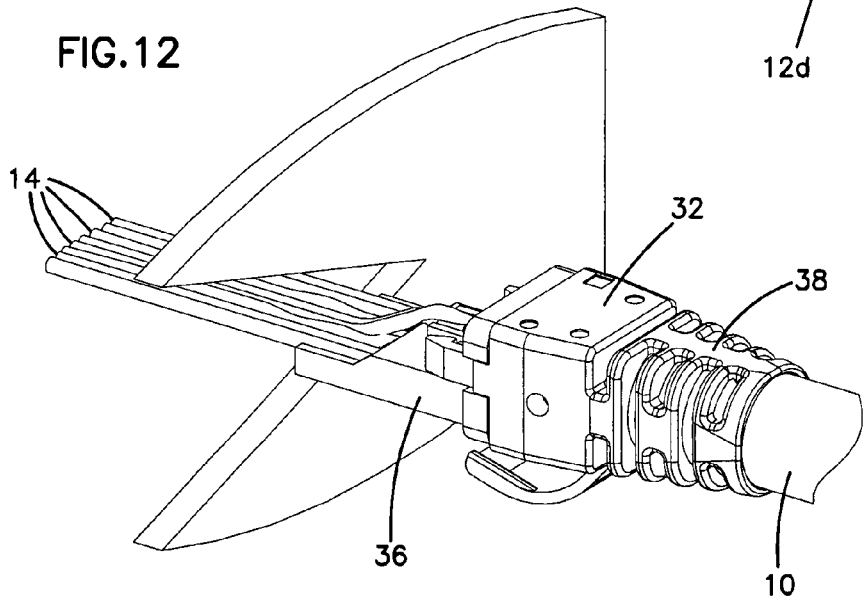
FIG. 12 is another partial perspective view of the patch cord of FIG. 11.

In the illustrate embodiment of FIG. 11, the conductors 14 of the second twisted pair 12*b* are positioned within the channels 44 at positions 1-2; the conductors 14 of the third twisted pair 12*c* are positioned within the channels 44 at positions 4-5; and the conductors 14 of the fourth twisted pair 12*d* are positioned within the channels 44 at positions 7-8. The first twisted pair 12*a* is known as the split pair; the conductors 14 of the split pair 12*a* are positioned within the channels 44 at position 3-6. Other wire placement configurations can be utilized in accordance with the principles disclosed, depending upon the requirements of the particular application. When the conductors 14 of each of the twisted pairs 12*a*-12*d* are properly positioned with the channeled insert 36, the conductors 14 are trimmed, as shown in FIG. 12.

Referring back to FIG. 4, with the conductors 14 trimmed, the plug housing 34 of the jack 30 is snap-fit onto the connector housing 32 and the channeled insert 36. The plug housing 34 includes eight contacts (not shown) located to correspondingly interconnect with the eight insulated conductors 14 of the twisted pairs 12. The eight contacts of the plug housing 34 include insulation displacement contacts that make electrical contact with the conductors 14. In the illustrated embodiment, the conductors 14 of the second twisted pair 12*b* terminate at contact positions 1-2; the conductors of the first twisted pair 12*a* (the split pair) terminate at contact positions 3-6; the conductors of the third twisted pair 12*c* terminate at contact positions 4-5; and the conductors of the fourth twisted pair 12*d* terminate at contact positions 7-8.

Figure 13:
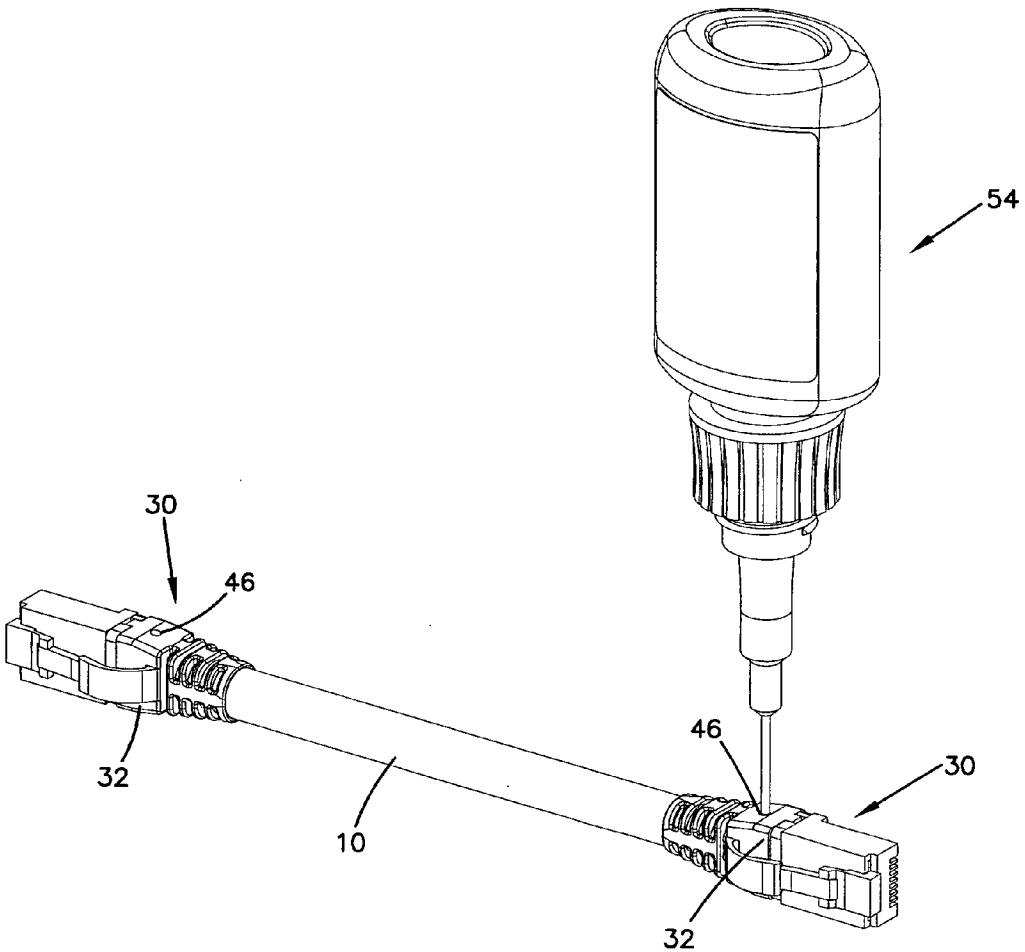
FIG. 13 is a perspective view of the patch cord of FIG. 4, showing one step of one method of assembling the patch cord.

As previously described, the jack 30 is secured to the end of the cable 10 by the clamping force of the prongs 56 on the outer diameter OD2 of the inner jacket 24. To further ensure the relative securing of the jack 30 and the cable 10, additional steps are taken. In particular, as shown in FIG. 6, a through hole 46 is provided in the connector housing 32 of the jack 30. The through hole 46 extends from a first side 48 of the connector housing 32 to a second opposite side 52. In the illustrated embodiment, the through hole 46 is approximately 0.063 inches in diameter. As shown in FIG. 13, adhesive 54 is deposited within the hole 46 to form a bond between the inner jacket 24 and the connector housing 32 of the jack 30. The adhesive ensures that the jack 30 remains in place relative to the end of the cable 10.

In general, to promote circuit density, the contacts of the jacks 30 are required to be positioned in fairly close proximity to one another. Thus, the contact regions of the jacks are particularly susceptible to crosstalk. Furthermore, contacts of certain twisted pairs 12 are more susceptible to crosstalk than others. In particular, crosstalk problems arise most commonly at contact positions 3-6, the contact positions at which the split pair (e.g., 12*a*) is terminated.

The disclosed lay lengths of the twisted pairs 12*a*-12*b* and of the cable core 20 of the disclosed patch cord 50 reduce problematic crosstalk at the split pair 12*a*. Test results that illustrate such advantageous cable or patch cord performance are shown in FIGS. 14-17.

Figure 14:
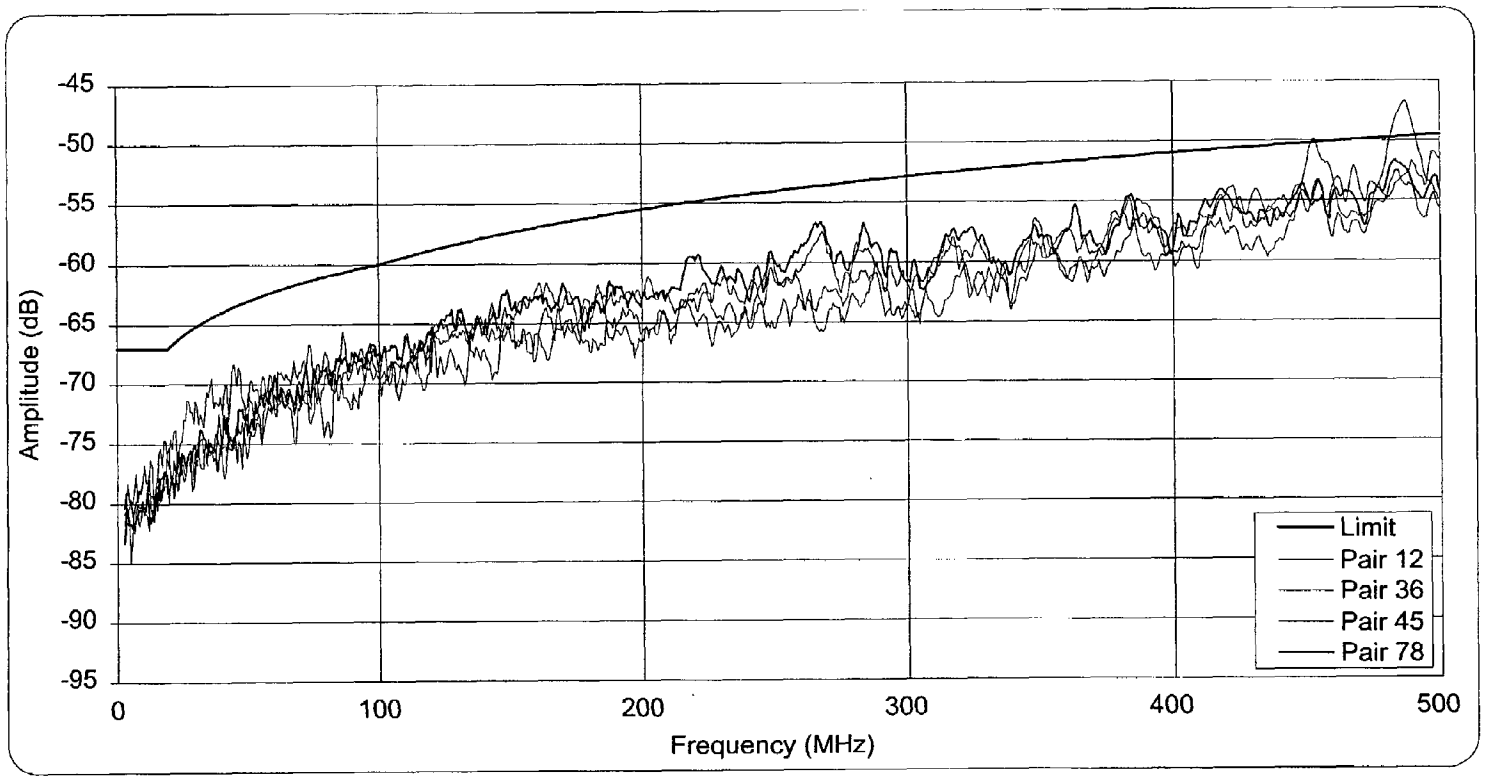
FIG. 14 is a graph of test data of a patch cord manufactured without a varying cable core lay length.

Referring to FIG. 14, test results of the performance of a first patch cord having four twisted pairs are illustrated. Each of the twisted pairs of the first patch cord has a particular initial twist rate different from that of the others. The cable core defined by the four twisted pairs of this first patch cord is twisted at a constant rate that defines a constant lay length of 2.0 inches. The test results show that the twisted pair (the split pair) corresponding to contact positions 3-6 (Pair 36) experiences an unacceptable level of signal coupling (e.g., noise transmission or cross talk). In particular, the split Pair 36 exceeds a maximum limit shown in FIG. 14 by as much as 2.96 decibels at a frequency of 486.9 MHz. This amount of signal coupling falls outside the acceptable performance standards established by the telecommunications industry.

Figure 15:
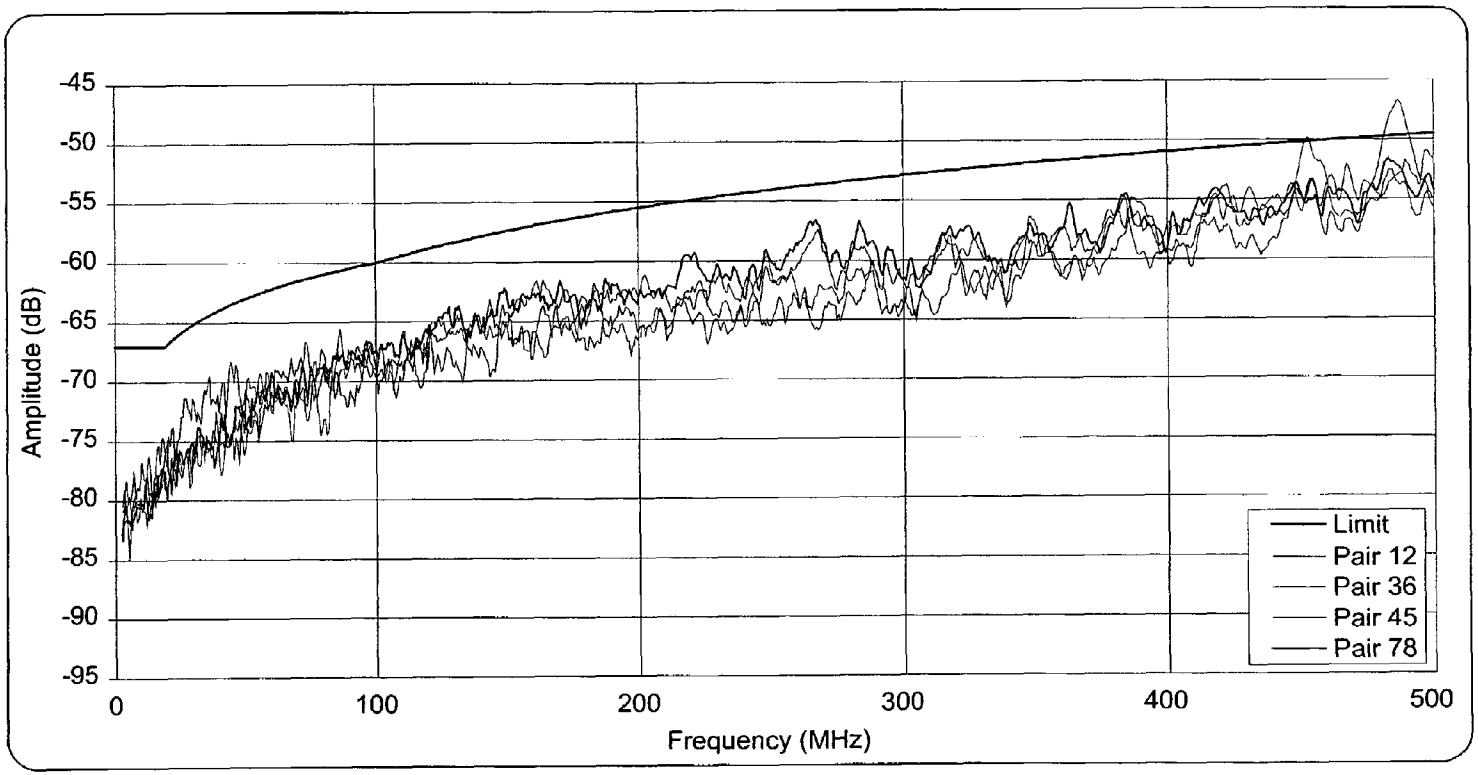
FIG. 15 is a graph of test data of a patch cord manufactured with a varying cable core lay length in accordance with the principles disclosed.

FIG. 15 illustrates the performance of a second patch cord having four twisted pairs, each twisted pair having the same particular initial twist rate as that of the first patch cord represented in FIG. 14. In accord with the principles disclosed, however, the cable core defined by the four twisted pairs of this second patch cord is randomly twisted such that the patch cord has a randomly varying lay length of between 1.5 inches and 2.5 inches. The test results show that none of the twisted pairs, including the split pair corresponding to contact position 3-6 (Pair 36), experiences an unacceptable level of signal coupling. Rather, the split Pair 36, for example, has its greatest signal coupling at a frequency of 447.61. At this frequency, the split Pair 36 still has not reached the maximum limit, and is in fact 4.38 decibels from the maximum limit. This amount of signal coupling falls within the acceptable performance standards established by the telecommunications industry.

Figure 16:
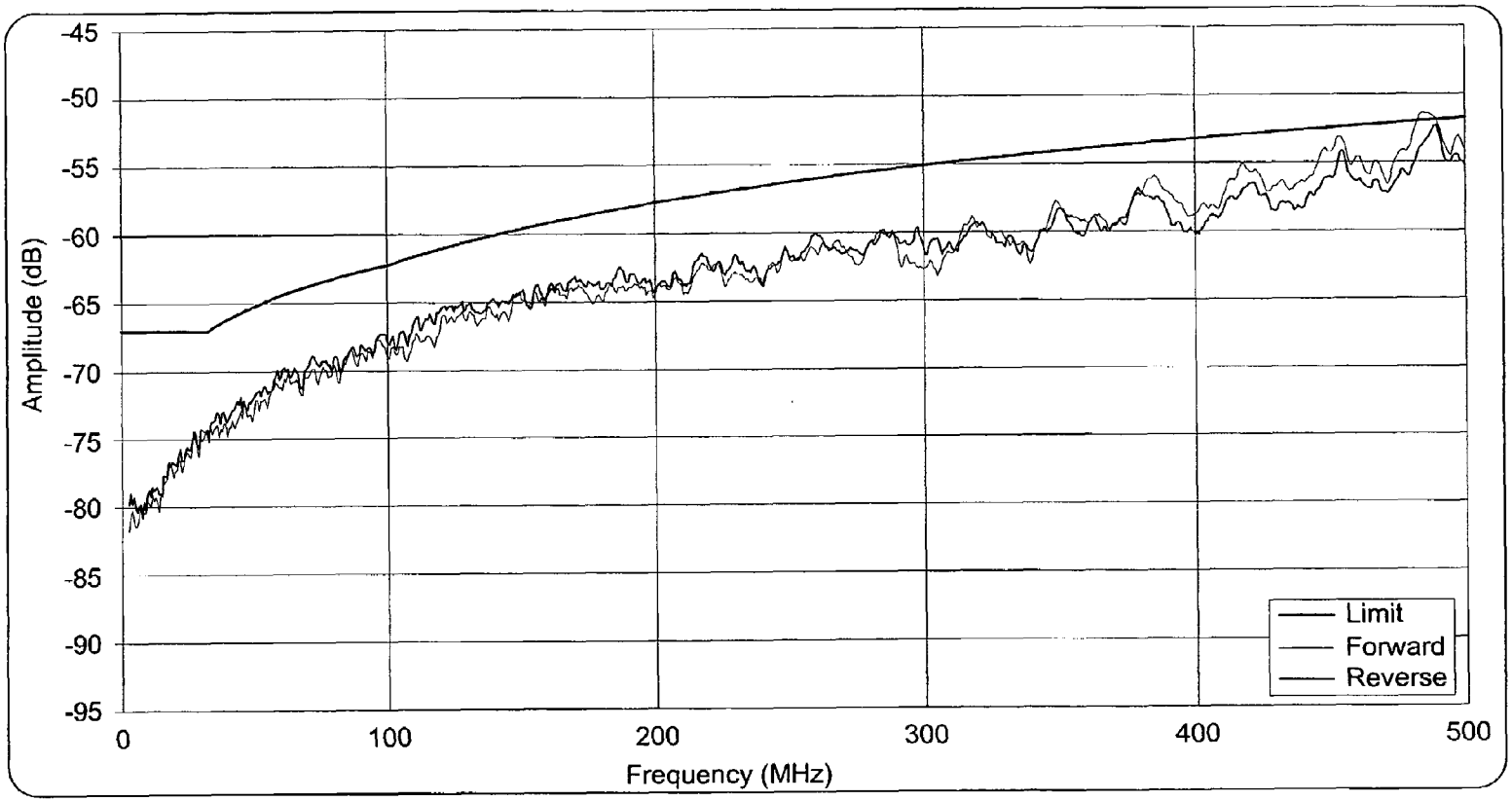
FIG. 16 is another graph of test data of the patch cord described with respect to FIG. 14.
Figure 17:
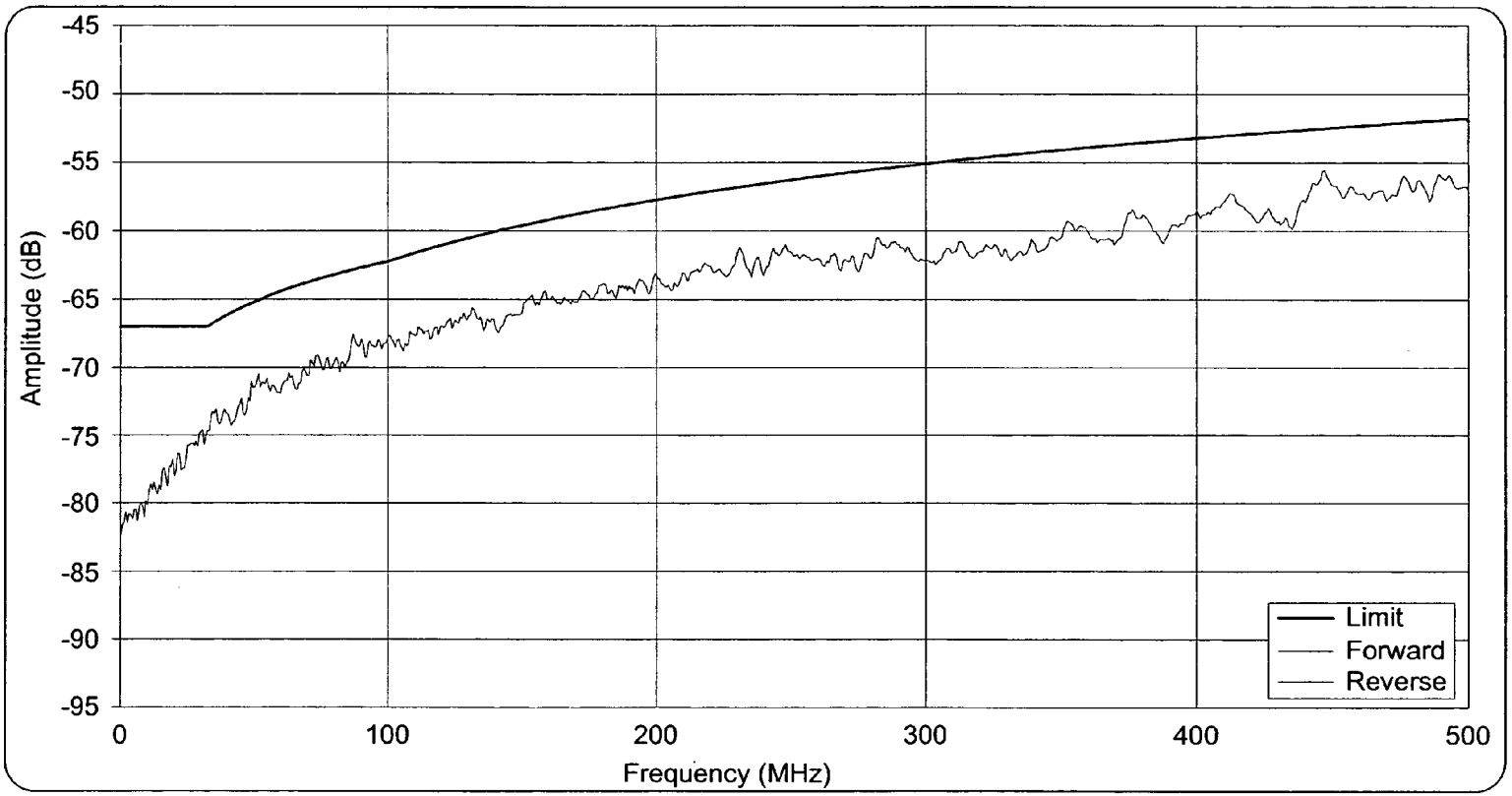
FIG. 17 is another graph of test data of the present patch cord described with respect to FIG. 15.

FIGS. 16 and 17 illustrate similar cable performance test results. FIG. 16 illustrates the overall signal transmission/signal coupling performance of the first patch cord having the constant lay length of 2.0 inches. The first patch cord exceeds the maximum limit shown in FIG. 16 by as much as 0.57 decibels at a frequency of 484.41 MHz. This amount of signal coupling falls outside the acceptable performance standards established by the telecommunications industry. In contrast, FIG. 17 illustrates the second patch cord manufactured with the randomly varying lay length of between 1.5 and 2.5 inches. The second patch cord experiences its greatest signal coupling at a frequency of 446.98 MHz. At this frequency, the second patch cord still has not reached the maximum limit, and is in fact 3.09 decibels from the maximum limit. This amount of signal coupling falls within the acceptable performance standards established by the telecommunications industry.

The patch cord 50 of the present disclosure reduces the occurrence of crosstalk at the contact regions of the jacks, while still accommodating the need for increased circuit density. In particular, the cable 10 of the patch cord 50, reduces the problematic crosstalk that commonly arise at the split pair contact positions 3-6 of the patch cord jack. The reduction in crosstalk at the split pair (e.g., 12*a*) and at the contacts of the jack 30 enhances and improves the overall performance of the patch cord.

The above specification provides a complete description of the present invention. Since many embodiments of the invention can be made without departing from the spirit and scope of the invention, certain aspects of the invention reside in the claims hereinafter appended.

What is claimed is:

1. A multi-pair cable having a length, comprising:

a) a first twisted pair having a first mean lay length;

b) a second twisted pair having a second mean lay length;

c) a third twisted pair having a third mean lay length; and d) a fourth twisted pair having a fourth mean lay length; the mean lay lengths of each of the twisted pairs being different from one another;

e) wherein the first, second, third, and fourth twisted pairs define a cable core, the cable core having a varying core lay length that varies at least 1 inch along the length of the cable, the cable core having a mean core lay length of less than about 2.5 inches.

2. The cable of claim 1, wherein the varying core lay length of the cable core varies between about 1.5 inches and about 2.5 inches.

3. The cable of claim 2, wherein the varying core lay length of the cable core randomly varies between about 1.5 inches and about 2.5 inches.

4. The cable of claim 1, wherein the first mean lay length of the first twisted pair is about 0.288 inches.

5. The cable of claim 4, wherein the second mean lay length of the second twisted pair is about 0.330 inches.

6. The cable of claim 5, wherein the third mean lay length of the third twisted pair is about 0.306 inches.

7. The cable of claim 6, wherein the fourth mean lay length of the fourth twisted pair is about 0.347 inches.

8. The cable of claim 1, wherein each of the twisted pairs has an initial lay length prior to twisting the cable core at the varying core lay length, the initial lay length of each twisted pair being a generally constant lay length.

9. The cable of claim 8, wherein the initial lay length of each of the twisted pairs is between 0.300 and 0.500 inches.

10. The cable of claim 1, further including a double jacket, the double jacket including an inner jacket that surrounds the cable core and an outer jacket that surrounds the inner jacket.

11. A method of making a multi-pair cable, comprising the steps of:

a) providing a plurality of twisted pairs each having an initial lay length, the initial lay length of each of the twisted pairs being different from that of the other twisted pairs, the plurality of twisted pairs defining a cable core; and b) twisting the cable core at a varying twist rate, the twist rate varying at least 1 inch along the length of the cable, the varying twist rate defining a mean core lay length of less than 2.5 inches.

12. The method of claim 11, wherein the step of twisting the cable core includes twisting the cable core at a varying twist rate between about 1.5 inches and about 2.5 inches.

13. The method of claim 12, wherein the step of twisting the cable core at the varying twist rate includes randomly twisting the cable core at a varying twist rate between about 1.5 inches and about 2.5 inches.

14. The method of claim 11, wherein twisting the cable core includes twisting the first twisted pair at a varying twist rate such that the first twisted pair has a first mean lay length of about 0.288 inches.

15. The method of claim 14, wherein twisting the cable core includes twisting the second twisted pair at a varying twist rate such that the second twisted pair has a second mean lay length of about 0.330 inches.

16. The method of claim 15, wherein twisting the cable core includes twisting the third twisted pair at a varying twist rate such that the third twisted pair has a third mean lay length of about 0.306 inches.

17. The method of claim 16, wherein twisting the cable core includes twisting the fourth twisted pair at a varying twist rate such that the fourth twisted pair has a fourth mean lay length of about 0.347 inches.

18. The method of claim 11, wherein the step of providing the plurality of twisted pairs includes providing twisted pairs having initial lay lengths that are generally constant.

19. The method of claim 18, wherein the step of providing the plurality of twisted pairs includes providing twisted pairs having lay lengths between 0.300 and 0.500 inches.

20. The method of claim 11, further including surrounding the cable core with a double jacket.

21. A patch cord, comprising:

a) a cable having a first end and a second end, the cable including:

i) a first twisted pair having a first mean lay length between the first and second ends of the cable;

ii) a second twisted pair having a second mean lay length between the first and second ends of the cable;

iii) a third twisted pair having a third mean lay length between the first and second ends of the cable; and iv) a fourth twisted pair having a fourth mean lay length between the first and second ends of the cable; the mean lay lengths of each of the twisted pairs being different from one another;

v) wherein the first, second, third, and fourth twisted pairs define a cable core, the cable core having a varying core lay length that varies at least 1 inch between the first and second ends of the cable, the varying core lay length of the cable core having a mean core lay length of less than about 2.5 inches;

b) first and second connector assemblies, the first connector assembly being attached to the first end of the cable, and the second connector assembly being attached to the second end of the cable.

22. The patch cord of claim 21, wherein the varying core lay length of the cable core varies between about 1.5 inches and about 2.5 inches between the first and second ends of the cable.

23. The patch cord of claim 22, wherein the varying core lay length of the cable core randomly varies between about 1.5 inches and about 2.5 inches between the first and second ends of the cable.

24. The patch cord of claim 21, wherein the first mean lay length of the first twisted pair is about 0.288 inches.

25. The patch cord of claim 24, wherein the second mean lay length of the second twisted pair is about 0.330 inches.

26. The patch cord of claim 25, wherein the third mean lay length of the third twisted pair is about 0.306 inches.

27. The patch cord of claim 26, wherein the fourth mean lay length of the fourth twisted pair is about 0.347 inches.

28. The patch cord of claim 21, wherein each of the twisted pairs has an initial lay length prior to twisting the cable core at the varying core lay length, the initial lay length of each twisted pair being a generally constant lay length.

29. The patch cord of claim 28, wherein the initial lay length of each of the twisted pairs is between 0.300 and 0.500 inches.

30. The patch cord of claim 21, wherein the cable includes a double jacket, the double jacket including an inner jacket that surrounds the cable core and an outer jacket that surrounds the inner jacket.

* * * * *

UNITED STATES PATENT AND TRADEMARK OFFICE

CERTIFICATE OF CORRECTION

PATENT NO. : 7,375,284 B2
APPLICATION NO. : 11/471982
DATED : May 20, 2008
INVENTOR(S) : Stutzman et al.

It is certified that error appears in the above-identified patent and that said Letters Patent is hereby corrected as shown below:

On the Title Page

Page 2, Item (56) References Cited, Foreign Patent Documents: "EP 0 367 473 A1 5/1990" should read --EP 0 367 453 A1 5/1990--

Signed and Sealed this
Sixteenth Day of December, 2014

Michelle K. Lee

Michelle K. Lee
*Deputy Director of the United States Patent and Trademark Office*